US007550901B2

(12) United States Patent
Chrysler et al.

(10) Patent No.: US 7,550,901 B2
(45) Date of Patent: Jun. 23, 2009

(54) PIEZOELECTRIC FAN, COOLING DEVICE CONTAINING SAME, AND METHOD OF COOLING A MICROELECTRONIC DEVICE USING SAME

(75) Inventors: Gregory M. Chrysler, Chandler, AZ (US); Ioan Sauciuc, Phoenix, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 11/862,194

(22) Filed: Sep. 27, 2007

(65) Prior Publication Data

US 2009/0085438 A1 Apr. 2, 2009

(51) Int. Cl.
*H01L 41/08* (2006.01)
*F04D 33/00* (2006.01)

(52) U.S. Cl. ..... 310/330; 310/311; 417/322; 417/413.2

(58) Field of Classification Search ..... 310/311; 417/322, 413.2
See application file for complete search history.

(56) References Cited

U.S. PATENT DOCUMENTS

| | | | | |
|---|---|---|---|---|
| 6,222,302 | B1 * | 4/2001 | Imada et al. | 310/321 |
| 7,321,184 | B2 * | 1/2008 | Lee et al. | 310/341 |
| 2006/0138905 | A1 | 6/2006 | Gonzales et al. | |
| 2007/0001550 | A1 | 1/2007 | Palanduz et al. | |
| 2007/0037506 | A1 * | 2/2007 | Lee et al. | 454/184 |
| 2008/0062644 | A1 * | 3/2008 | Petroski | 361/695 |
| 2008/0137289 | A1 * | 6/2008 | Arik et al. | 361/689 |

FOREIGN PATENT DOCUMENTS

| | | | |
|---|---|---|---|
| JP | 62072149 | A * | 4/1987 |
| JP | 01190999 | A * | 8/1989 |
| JP | 01219399 | A * | 9/1989 |
| JP | 03033500 | A * | 2/1991 |
| JP | 08330488 | A * | 12/1996 |

OTHER PUBLICATIONS

J. H. Cho, et al., "Efficiency of energy conversion by piezoelectrics", Applied Physics Letters, 89, 104107, 2006, 3 pages.
Ioan Sauciuc, et al., "Cooling Device, System Containing Same, and Cooling Method", U.S. Appl. No. 11/714,333, filed Mar. 6, 2007.
Iaon Sauciuc et al., "Future CPU Cooling Building Blocks—Performance and Challenges", Intel Assembly & Test Technology Journal, IATTJ, vol. 9, 2006, 12 pages.
Ioan Sauciuc, "Piezo Actuators for Electronics Cooling", Electronics Cooling, vol. 13, No. 1, Feb. 2007, pp. 12-17.
Javier Leija et al., "Heatsink, Method of Manufacturing Same, and Microelectronic Package Containing Same", U.S. Appl. No. 11/772,144, filed Jun. 30, 2007.
Hakan Erturk et al., "Piezoelectric Fan, Method of Cooling a Microelectronic Device Using Same, and System Containing Same", U.S. Appl. No. 11/828,759, filed Jul. 26, 2007.

* cited by examiner

*Primary Examiner*—Jaydi SanMartin
(74) *Attorney, Agent, or Firm*—Kenneth A. Nelson

(57) ABSTRACT

A piezoelectric fan includes a piezoelectric actuator patch (110, 210, 310) and a blade (120, 220, 320) attached to the piezoelectric actuator patch. The blade has a hole (121, 127, 221) in it, and a door (122, 128, 222) is adjacent to the hole and attached to the blade (as with a hinge (123, 129, 223)) such that the door is capable of opening and closing.

17 Claims, 5 Drawing Sheets

PIEZOELECTRIC FAN, COOLING DEVICE CONTAINING SAME, AND METHOD OF COOLING A MICROELECTRONIC DEVICE USING SAME

FIELD OF THE INVENTION

The disclosed embodiments of the invention relate generally to thermal management of microelectronic devices, and relate more particularly to piezoelectric cooling fans.

BACKGROUND OF THE INVENTION

Microelectronic devices generate heat during their operation, and this heat must be safely dissipated in order to improve reliability and performance and to prevent premature failure. One method of dissipating heat is to cause air to flow across regions of elevated temperature. This airflow carries heated air away from high temperature regions, placing it at cooler regions where its effect will not be problematic, and draws cooler air in to the high temperature regions to take the place of the heated air that is removed.

BRIEF DESCRIPTION OF THE DRAWINGS

The disclosed embodiments will be better understood from a reading of the following detailed description, taken in conjunction with the accompanying figures in the drawings in which.

Figure 1:
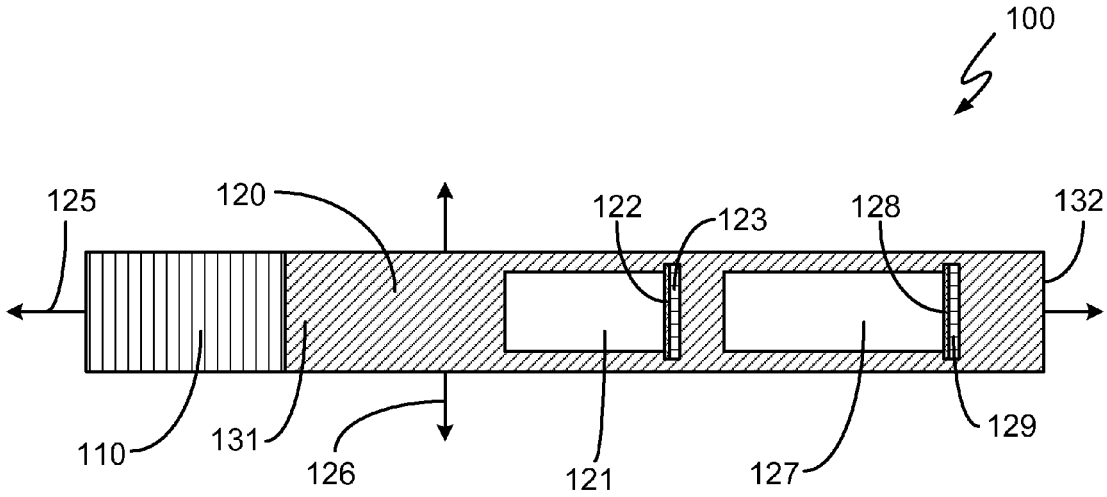
FIG. 1 is a plan view of a piezoelectric fan according to an embodiment of the invention.

For simplicity and clarity of illustration, the drawing figures illustrate the general manner of construction, and descriptions and details of well-known features and techniques may be omitted to avoid unnecessarily obscuring the discussion of the described embodiments of the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first,". "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method. Furthermore, the terms "comprise," "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein. The term "coupled," as used herein, is defined as directly or indirectly connected in an electrical or non-electrical manner. Objects described herein as being "adjacent to" each other may be in physical contact with each other, in close proximity to each other, or in the same general region or area as each other, as appropriate for the context in which the phrase is used. Occurrences of the phrase "in one embodiment" herein do not necessarily all refer to the same embodiment.

DETAILED DESCRIPTION OF THE DRAWINGS

In one embodiment of the invention, a piezoelectric fan comprises a piezoelectric actuator patch and a blade attached to the piezoelectric actuator patch. The blade has a hole in it, and a door is adjacent to the hole and attached to the blade (as with a hinge) such that the door is capable of opening and closing.

Piezoelectric fans generate airflow by converting an applied electric field to a stress or a strain in a piezoelectric material that is attached to a blade. The strain in the piezoelectric material causes a deflection that moves the blade with an amplitude that depends on the frequency and voltage of the applied electric field. This motion in a conventional piezoelectric fan generates local vortices that result in air re-circulation in the vicinity of the fan blades, thus limiting the cooling potential of the fan. Such local vortices rob energy and momentum from the moving air, thus interfering with the efficiency of the fan. Embodiments of the invention reduce or eliminate the air flow re-circulation and therefore increase the net air flow rate, resulting in better cooling performance. Embodiments of the invention may be of particular value in small form factor devices because they allow a system fan to be eliminated if desired.

Referring now to the drawings, FIG. 1 is a plan view of a piezoelectric fan 100 according to an embodiment of the invention. As illustrated in FIG. 1, piezoelectric fan 100 comprises a piezoelectric actuator patch 110 and a blade 120 attached to piezoelectric actuator patch 110 and comprising a hole 121 and a door 122 adjacent to hole 121. Door 122 is attached to blade 120 with a hinge 123 capable of allowing door 122 to open and close. Blade 120 has a long axis 125 and a short axis 126. As may be seen in FIG. 1, a longest dimension of hinge 123 is substantially parallel to short axis 126.

In one embodiment, blade 120 contains multiple holes, including hole 121, each one of which is associated with and adjacent to its own door that is attached to blade 120. Each one of these doors, like door 122, is attached to blade 120 with a hinge capable of allowing the door to open and close. In the illustrated embodiment, blade 120 further comprises a hole 127, located near hole 121, with a door 128 attached to blade 120 with a hinge 129. As an example, hole 127, door 128, and hinge 129 can be similar to, respectively, hole 121, door 122, and hinge 123.

FIG. 1 depicts doors 122 and 128 in an open position as if they were extending directly out of the paper toward the viewer. Accordingly, only their front edges are visible. Note that doors 122 and 128 are larger than holes 121 and 127, respectively, such that the doors are unable to pass through the holes. This is shown in FIG. 1 by the fact that doors 122 and 128 (along with hinges 123 and 129) extends past a perimeter of holes 121 and 127, i.e., the doors are wider than the holes. Doors 122 and 128 may also be longer than the holes, though such cannot be determined from the perspective of FIG. 1, or, in a non-illustrated embodiment, doors 122 and 128 may be longer but not wider then holes 121 and 127.

According to one embodiment, door 122 is made of a first material while door 128 is made of a different material. In at least one embodiment, doors 122 and 128 can be very thin—thinner than blade 120. The frequency of blade 120 may be tuned by selecting for doors 122 and 128 material having particular densities, masses, and other properties. Using doors made of different materials may enable blade 120 to be fashioned such that its resonant frequency is below 100 Hertz, which is an approximate threshold below which the blade's vibration cannot be heard. In a different embodiment, perhaps one where such frequency tuning is not necessary, both door 122 and door 128 may be made of the same or similar materials.

As an example, one or more of doors 122 and 128 (or others not illustrated) can be made of rubber, of fabric, of plastic, or the like. With respect to the rubber material, a wide range of sizes, textures, thicknesses, stiffness, and other characteristics are available. Rubber also has a very high modulus of elasticity and therefore produces a door having a low resonant frequency, with the attendant advantages described above. If plastic is used it may in one embodiment be thinner than blade 120. Whatever material is used, it should in general be thin, light, and flexible so that it may bend with blade 120 without adding more than a minimal amount of weight.

If plastic is used for blade 120 as well as door 122 (and/or door 128) then hinge 123 (and/or hinge 129) can be formed through a simple solvent bonding process in which the surfaces of blade and door are dissolved with a solvent and pressed together. When the solvent evaporates the two parts solidify and become one piece that acts as the hinge. In other words, the solvent bonding process will attach door 122 (and/or door 128) to blade 120 and the overlap region at one end of the door would become hinge 123 (and/or hinge 129). If the blade is metal, fabric or plastics could still be used to construct the doors, but the attachment would probably require glue or another adhesive (because metals will not dissolve in a solvent).

Referring still to FIG. 1, blade 120 has a base 131 adjacent to piezoelectric actuator patch 110 and a tip 132 opposite base 131. Hole 127, with door 128 and hinge 129, each of which are adjacent to tip 132, are closer to tip 132 than any of the other holes or doors of blade 120. Hole 127 and door 128 are also larger than the other holes of doors of blade 120. A reason for this is that tip 132 moves faster than other portions of blade 120 because of the greater distance it must travel during a given time period. Because of its proximity to the faster-moving tip 132, door 128 experiences a greater amount of force due to the motion of blade 120 than other doors that are farther from tip 132, and this greater force is sufficient to close a larger (and heavier) door.

Figure 2:
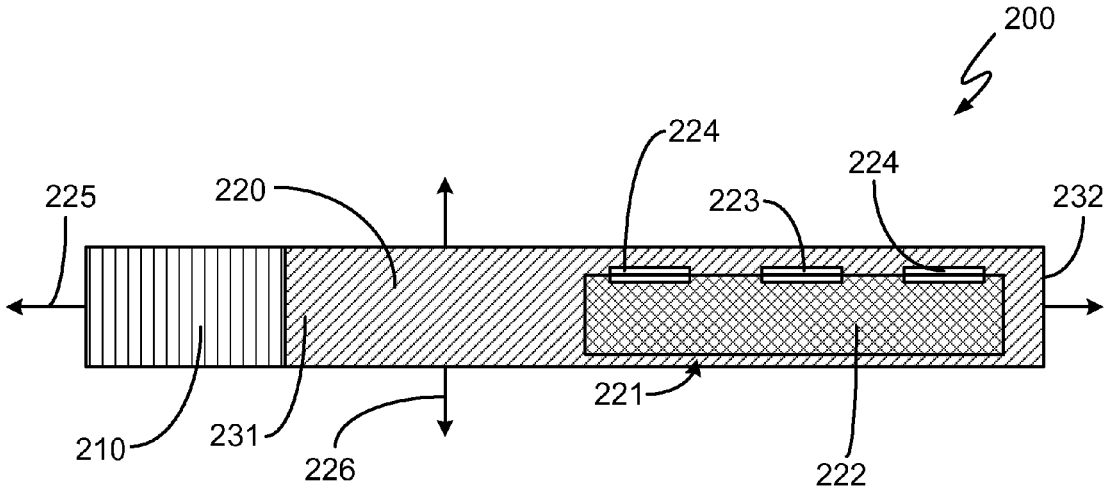
FIG. 2 is a plan view of a piezoelectric fan according to another embodiment of the invention.

FIG. 2 is a plan view of a piezoelectric fan 200 according to an embodiment of the invention. As illustrated in FIG. 2, piezoelectric fan 200 comprises a piezoelectric actuator patch 210 and a blade 220 attached to piezoelectric actuator patch 210. Blade 220 comprises a hole 221 and a door 222 adjacent to hole 221. Door 222 is larger (e.g., wider and/or longer) than hole 221, which means that hole 221 is not visible in FIG. 2. (Its presence, however, is indicated with a reference numeral and an arrow.) Although only a single door is shown, a non-illustrated embodiment may have more than one door. Space constraints, manufacturing details, and other factors will limit the number of doors that may be used.

Door 222 is attached to blade 220 with a hinge 223 capable of allowing door 222 to open and close. As an example, piezoelectric actuator patch 210, blade 220, hole 221, and door 222 can be similar to, respectively, piezoelectric actuator patch 110, blade 120, hole 121, and door 122, all of which are shown in FIG. 1. In some respects, hinge 223 can be similar to hinge 123, also shown in FIG. 1, but certain differences, as in orientation with respect to the fan blade, may exist for at least some embodiments, as more fully described below.

Blade 220 has a long axis 225 and a short axis 226. As may be seen in FIG. 2, a longest dimension of hinge 223 is substantially parallel to long axis 225. This orientation of hinge 223 means that door 222 swings from side to side of blade 220 (rather than swinging from end to end (i.e., base to tip or vice versa) as was the case with door 122 of piezoelectric fan 100).

In some embodiments, piezoelectric fan 200 further comprises additional hinges 224 that work with hinge 223 to attach door 222 to blade 220. Various embodiments employ one or more of hinges 223 and 224, and locate them in various places along door 222, whether at a center of door 222 at or near where hinge 223 is shown in FIG. 2, toward an end of door 222 at or near where hinges 224 are shown in FIG. 2, or at some other location (such as on the other side of hole 221).

In the illustrated embodiment, door 222 has a first length and hinge 223 has a second length that is no more than one third as great as the first length, and in some cases much shorter. A reason for this is that in the FIG. 2 configuration the length of the spring tends to stiffen blade 220, since they are aligned with a direction along which blade 120 bends during its motion, with longer springs augmenting this effect. Accordingly, shorter springs may be preferred for at least some embodiments of piezoelectric fan 200 (or other piezoelectric fans according to other embodiments of the invention).

Figure 3:
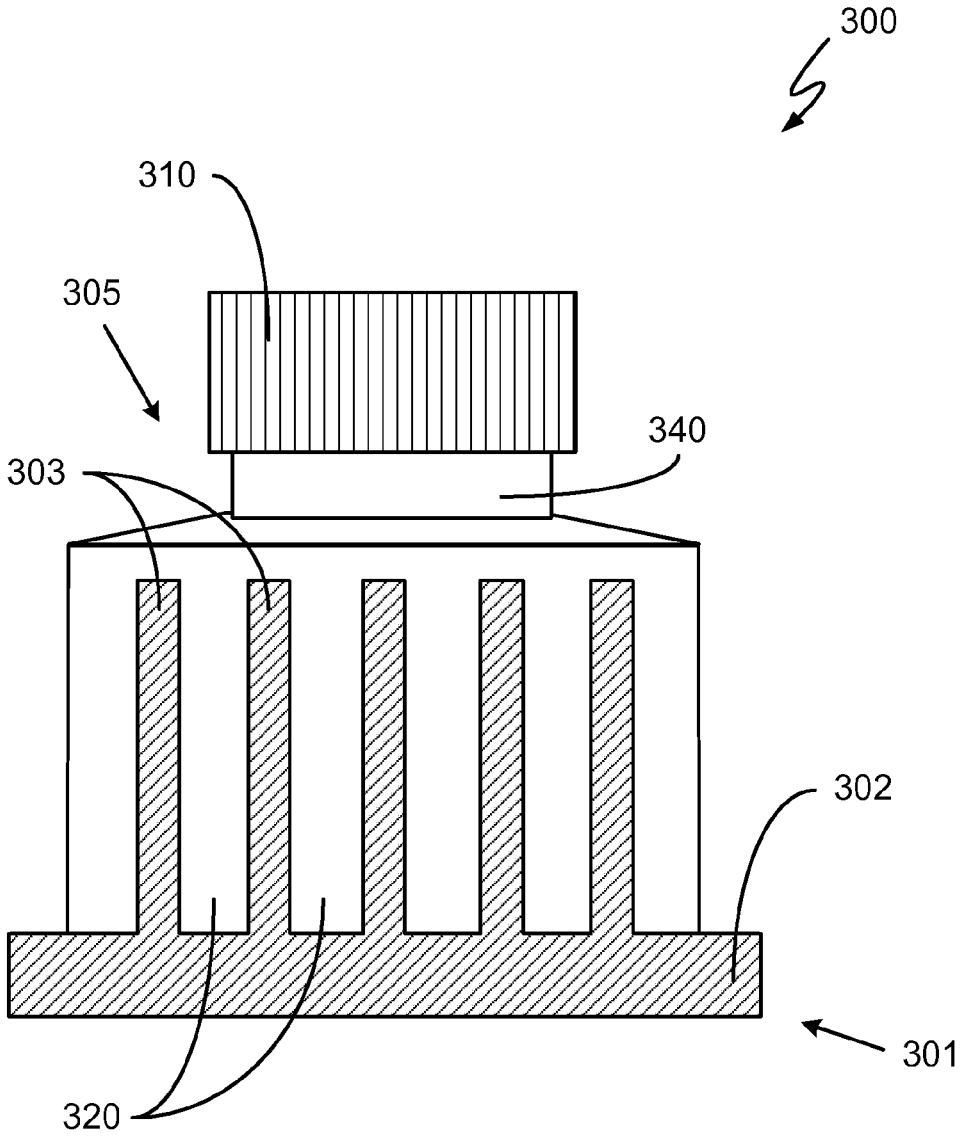
FIG. 3 is an elevational view of a cooling device containing a piezoelectric fan according to an embodiment of the invention.

FIG. 3 is an elevational view of a cooling device 300 containing a piezoelectric fan according to an embodiment of the invention. As illustrated in FIG. 3, cooling device 300 comprises a heatsink 301 having a base 302 and a plurality of fins 303 extending from base 302. Cooling device 300 further comprises a piezoelectric fan 305 comprising a piezoelectric actuator patch 310 to which are attached a plurality of blades 320. (It should be understood that although piezoelectric fan 305 contains a plurality of fan blades, other embodiments of the invention, including, for example, those shown in FIGS. 1 and 2, may or may not have multiple blades. In some embodiments such fans may have only the single blade shown.)

A neck 340 adjacent to actuator patch 310 intervenes between blades 320 and piezoelectric actuator patch 310. Each one of blades 320 is similar to blade 120 that is shown in FIG. 1. Accordingly, each one of blades 320 comprises a hole and a door adjacent to the hole, and the door is attached to the blade with a hinge that permits the door to open and close. The holes, doors, and hinges of blades 320 are not shown in FIG. 3, but they are similar to hole 121, door 122, and hinge 123, all of which are shown in FIG. 1. As may be seen in FIG. 3, plurality of fins 303 and plurality of blades 320 are arranged in alternating relationship to each other.

The motion of plurality of blades 320, from the perspective of FIG. 3, would be into and out of the paper. In a non-illustrated embodiment, adjacent fan blades could be made to oscillate in such a way that the blades move away from each other and then toward each other so as to rapidly force air from between them as they approach each other.

Figure 4:
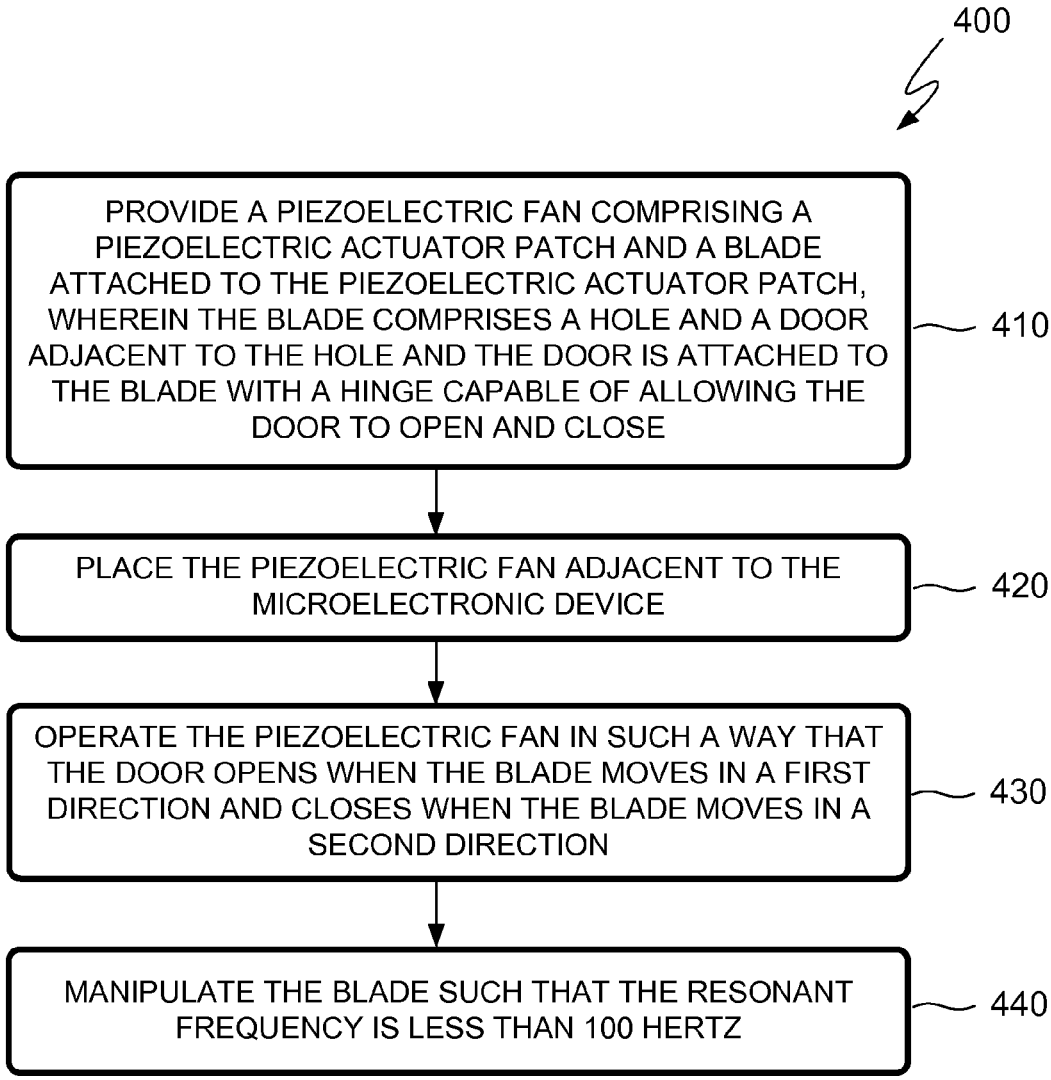
FIG. 4 is a flowchart illustrating a method of cooling a microelectronic device according to an embodiment of the invention.

FIG. 4 is a flowchart illustrating a method 400 of cooling a microelectronic device according to an embodiment of the invention. A step 410 of method 400 is to provide a piezoelectric fan comprising a piezoelectric actuator patch and a blade attached to the piezoelectric actuator patch, wherein the blade comprises a hole and a door adjacent to the hole and the door is attached to the blade with a hinge capable of allowing the door to open and close. As an example, the piezoelectric actuator patch, the blade, the hole, the door, and the hinge can be similar to, respectively, piezoelectric actuator patch 110, blade 120, hole 121, door 122, and hinge 123, each of which are shown in FIG. 1.

A step 420 of method 400 is to place the piezoelectric fan adjacent to the microelectronic device. In this context, "adjacent to" means near enough to influence a temperature of the microelectronic device.

A step 430 of method 400 is to operate the piezoelectric fan in such a way that the door opens when the blade moves in a first direction and closes when the blade moves in a second direction. In one embodiment, step 430 comprises driving the blade at its resonant frequency. Opening the door when the fan moves in one direction but not the other reduces the amount of air that is pulled back into the vicinity of the blade, thus increasing the amount of hot air that is moved away from the blade and, as a result, enhancing cooling performance.

A step 440 of method 400 is to manipulate the blade such that the resonant frequency is less than 100 Hertz. In one embodiment, step 440 comprises selecting a material out of which to manufacture the door, the material being one that, when combined with the other materials of the blade, will produce a resonant frequency of a desired value.

Figure 5:
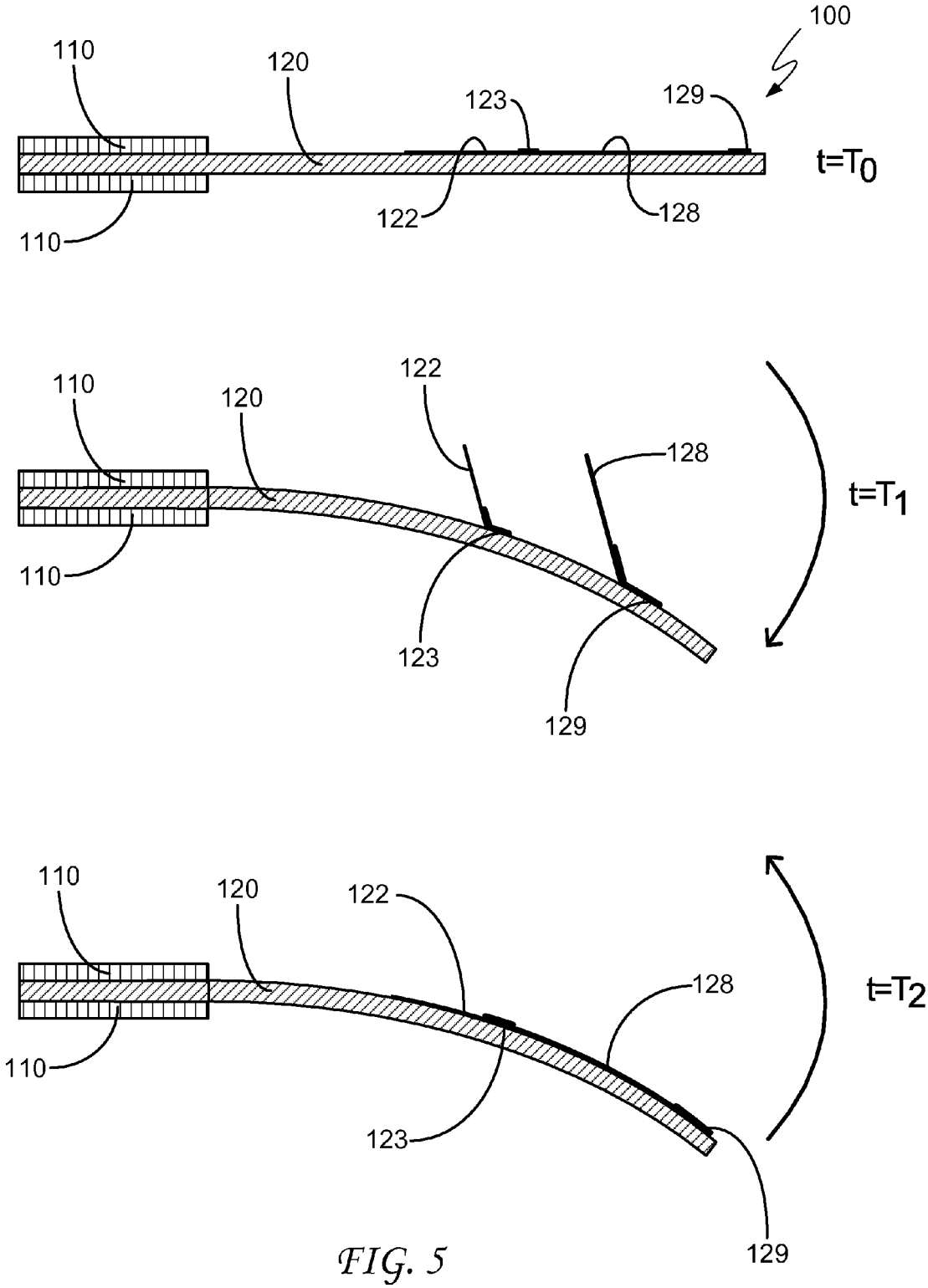
FIG. 5 is a side view of the piezoelectric fan of FIG. 1 as operated according to an embodiment of the invention.

FIG. 5 is a side view of piezoelectric fan 100 as operated according to an embodiment of the invention. As illustrated in FIG. 5, at time t=0 blade 120 is stationary and is parallel to piezoelectric actuator patch 110. Gravity holds doors 122 and 128 in place against blade 120 such that they cover, respectively, holes 121 and 127 (neither of which are visible in FIG. 5). At time $T_1$, blade 120 has swung downward, in response to a stimulus from piezoelectric actuator patch 110, causing doors 122 and 128 to swing open thus allowing air to flow through holes 121 and 127. At time $T_2$, blade 120 has begun to swing upward, in response to a stimulus from piezoelectric actuator patch 110, causing doors 122 and 128 to swing shut against blade 120, thus closing off holes 121 and 127.

The distortion of doors 122 and 128 and hinges 123 and 129 at time $T_1$ may be exaggerated in order to be more clearly evident. It should be understood that a similar response from doors 122 and 128 would take place if the motion of blade 120 were side-to-side. In general, the doors will swing open when the blade moves in the direction of the side of the blade opposite the doors (the lower side in FIG. 5) and swing closed when the blade moves in the direction of the side of the blade on which the doors are located (the upper side in FIG. 5).

Figure 6:
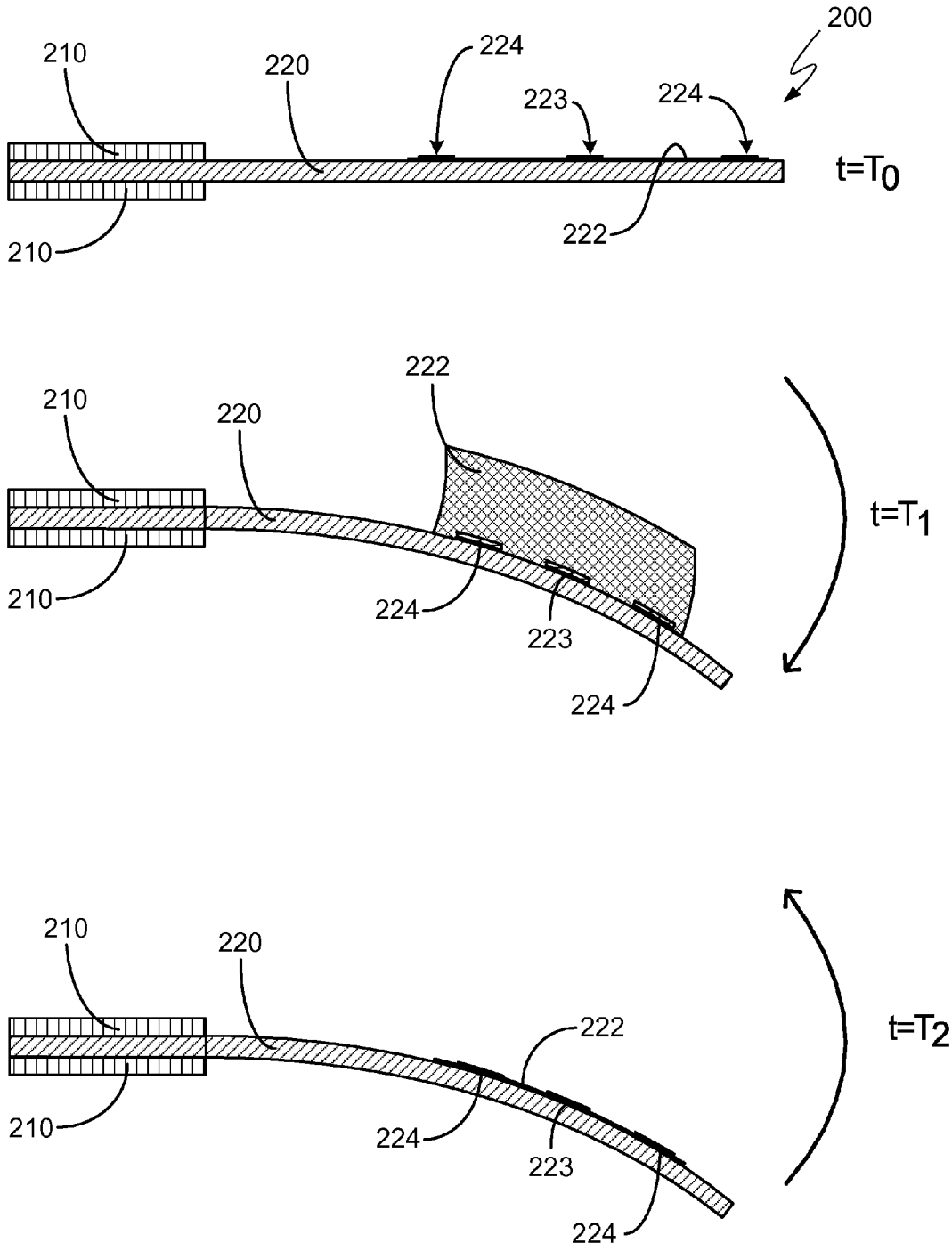
FIG. 6 is a side view of the piezoelectric fan of FIG. 2 as operated according to an embodiment of the invention.

FIG. 6 is a side view of piezoelectric fan 200 as operated according to an embodiment of the invention. As illustrated in FIG. 6, at time t=0 blade 220 is stationary and is parallel to piezoelectric actuator patch 210. Gravity holds door 222 in place against blade 220 such that it covers hole 221 (which is not visible in FIG. 6). At time $T_1$, blade 220 has swung downward, in response to a stimulus from piezoelectric actuator patch 210, causing door 222 to swing open thus allowing air to flow through hole 221. The distortion of door 222 and hinges 223 and 224 at time $T_1$ may be exaggerated in order to be more clearly evident. In other embodiments it may be that door 222 and hinges 223 and 224 are not distorted and that blade 220 is distorted instead. In other embodiments, door, hinges, and blade may all be distorted to some degree during the operation of the piezoelectric fan.

At time $T_2$, blade 220 has begun to swing upward, in response to a stimulus from piezoelectric actuator patch 210, causing door 222 to swing shut against blade 220, thus closing off hole 221. It should be understood that a similar response from door 222 would take place if the motion of blade 220 were side-to-side. In general, the door will swing open when the blade moves in the direction of the side of the blade opposite the door (the lower side in FIG. 6) and swing closed when the blade moves in the direction of the side of the blade on which the door is located (the upper side in FIG. 6).

Although the invention has been described with reference to specific embodiments, it will be understood by those skilled in the art that various changes may be made without departing from the spirit or scope of the invention. Accordingly, the disclosure of embodiments of the invention is intended to be illustrative of the scope of the invention and is not intended to be limiting. It is intended that the scope of the invention shall be limited only to the extent required by the appended claims. For example, to one of ordinary skill in the art, it will be readily apparent that the piezoelectric fans and related methods discussed herein may be implemented in a variety of embodiments, and that the foregoing discussion of certain of these embodiments does not necessarily represent a complete description of all possible embodiments.

Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A piezoelectric fan comprising:

a piezoelectric actuator patch; and a blade attached to the piezoelectric actuator patch, wherein the blade comprises:

a hole; and a door adjacent to the hole, the door attached to the blade with a hinge capable of allowing the door to open and close, wherein:

the hole is a first hole of a plurality of holes in the blade;

the door is a first door of a plurality of doors attached to the blade;

each one of the plurality of doors is, like the first door, adjacent to one of the plurality of holes;

each one of the plurality of doors is, like the first door, attached to the blade with a hinge capable of allowing the door to open and close;

the first door of the plurality of doors is made of a first material; and a second door of the plurality of doors is made of a second material that is different from the first material.

2. The piezoelectric fan of claim 1 wherein:
the blade has a long axis and a short axis; and
the hinge is substantially parallel to the short axis.

3. The piezoelectric fan of claim 1 wherein:
the blade has a base adjacent to the piezoelectric actuator patch and a tip opposite the base;
the first hole and the first door are adjacent to the tip, and no other hole of the plurality of holes and no other door of the plurality of doors is closer to the tip than are the first hole and the first door; and
the first hole is larger than the other holes of the plurality of holes and the first door is larger than the other doors in the plurality of doors.

4. The piezoelectric fan of claim 1 wherein:
the blade has a long axis and a short axis; and
the hinge is substantially parallel to the long axis.

5. The piezoelectric fan of claim 4 wherein:
the door has a first length and the hinge has a second length; and
the second length is no more than one third as great as the first length.

6. The piezoelectric fan of claim 1 wherein:
the door is made of rubber.

7. The piezoelectric fan of claim 1 wherein:
the door is made of fabric.

8. The piezoelectric fan of claim 1 wherein:
the door is made of plastic.

9. A cooling device comprising:
a heatsink having a base and a plurality of fins extending from the base; and
a piezoelectric fan,
wherein:
the piezoelectric fan comprises:
a piezoelectric actuator patch; and
a plurality of blades attached to the piezoelectric actuator patch;
each one of the plurality of blades comprises:
a hole; and
a door adjacent to the hole;
the door is attached to the one of the plurality of blades with a hinge capable of allowing the door to open and close;
the plurality of fins and the plurality of blades are arranged in alternating relationship to each other;
the hole is a first hole of a plurality of holes in each one of the plurality of blades;
the door is a first door of a plurality of doors attached to each one of the plurality of blades;
each one of the plurality of doors is, like the first door, adjacent to one of the plurality of holes;
each one of the plurality of doors is, like the first door, attached to one of the plurality of blades with a hinge capable of allowing the door to open and close;
the blade has a base adjacent to the piezoelectric actuator patch and a tip opposite the base;
the first hole and the first door are adjacent to the tip, and no other hole of the plurality of holes and no other door of the plurality of doors is closer to the tip than are the first hole and the first door; and
the first hole is larger than the other holes of the plurality of holes and the first door is larger than the other doors in the plurality of doors.

10. The cooling device of claim 9 wherein:
each one of the plurality of blades has a long axis and a short axis; and
each one of the hinges is substantially parallel to the short axis.

11. The cooling device of claim 9 wherein:
the first door in each blade is made of a first material; and
a second door of the plurality of doors in each blade is made of a second material that is different from the first material.

12. The cooling device of claim 9 wherein:
each one of the plurality of blades has a long axis and a short axis; and
the hinge is substantially parallel to the long axis.

13. The cooling device of claim 9 wherein:
each one of the plurality of doors is made of a material selected from the group consisting of rubber, fabric, and plastic.

14. A method of cooling a microelectronic device, the method comprising:
providing a piezoelectric fan comprising:
a piezoelectric actuator patch; and
a blade attached to the piezoelectric actuator patch, wherein the blade comprises a plurality of holes and a plurality of doors adjacent to the plurality of holes, wherein each one of the plurality of doors is attached to the blade with a hinge capable of allowing each one of the plurality of doors to open and close and wherein a first one of the plurality of doors is made of a first material and a second one of the plurality of doors is made of a second material that is different from the first material;
placing the piezoelectric fan adjacent to the microelectronic device; and
operating the piezoelectric fan in such a way that each one of the plurality of doors opens when the blade moves in a first direction and closes when the blade moves in a second direction.

15. The method of claim 14 wherein:
operating the piezo electric fan comprises driving the blade at its resonant frequency.

16. The method of claim 15 further comprising:
manipulating the blade such that a resonant frequency of the blade is less than 100 Hertz.

17. The method of claim 16 wherein:
manipulating the blade comprises selecting a material out of which to manufacture the each one of the plurality of doors.

* * * * *